US006402006B1

(12) United States Patent
Nunes et al.

(10) Patent No.: US 6,402,006 B1
(45) Date of Patent: Jun. 11, 2002

(54) DUAL MODE STAPLER WITH AUTOMATIC MODE TRANSITION

(75) Inventors: Vincente P. Nunes, Mississauga; Jeffrey R. Hudson, Oakville; Benjamin Tak-Cheung Wong, Brampton; Rogerio Goncalves, Mississauga, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/939,490

(22) Filed: Aug. 27, 2001

(51) Int. Cl.[7] ..... B25C 7/00

(52) U.S. Cl. ..... 227/110; 227/111; 227/148; 227/155; 270/37; 270/58.08

(58) Field of Search ..... 227/100, 110, 227/111, 107, 155, 148; 270/58.01, 58.07, 58.08, 58.11, 58.27

(56) References Cited

U.S. PATENT DOCUMENTS 4,313,670 A 2/1982 Caldwell ..... 355/3
5,447,298 A * 9/1995 Watanabe et al. ..... 270/58.11
5,573,233 A * 11/1996 Hirai et al. ..... 270/58.08
5,639,078 A 6/1997 Mandel et al. ..... 270/58.12
5,662,318 A * 9/1997 Harada et al. ..... 227/111
5,772,197 A * 6/1998 Aoki et al. ..... 270/58.08
5,842,624 A * 12/1998 Ishida ..... 227/148
H1842 H 3/2000 Tontarski ..... 227/100
6,092,712 A * 7/2000 Rueckl ..... 227/110
6,164,511 A * 12/2000 Chung et al. ..... 270/37

* cited by examiner

*Primary Examiner*—Scott A. Smith

(57) ABSTRACT

A dual mode stapling system with a first mode for plurally stapling a set of sheets parallel to one edge and a second mode for corner stapling at an angle to a set of sheets, with a single stapler mounted for linear movement by a simple linear repositioning system to selected stapling positions, but selectively further movable by the same linear repositioning system into a transition area where the stapler is automatically pivoted into the second stapling mode for corner stapling by a camming member which engages and pivots the stapler. A spring automatically reverse pivots the stapler back to the first stapling mode position when the linear repositioning system is reversed. The linear repositioning system may be a single reversable stepper motor driven leadscrew.

6 Claims, 2 Drawing Sheets

DUAL MODE STAPLER WITH AUTOMATIC MODE TRANSITION

Disclosed in the embodiment herein is an improved low cost and simple dual mode stapling system with an improved mode transition system.

In particular, there is disclosed in the embodiment herein a sheet set stapling system capable of stapling a compiled set or stack of sheets in a desired "corner stapling" position with angled staple insertion, and yet also capable of stapling a compiled set or stack of sheets in plural different stapling positions along an edge thereof, and an improved system for automatically changing between those two different stapling modes.

Normally, and desirably for increased top and bottom sheet tear resistance, such edge stapling function or mode inserts plural staples parallel to the sheet stack edge. Normally, but not necessarily, that plural edge stapling is perpendicular to the direction of movement of the sheets in a sheet path and thus along the leading or trailing edge of the set of sheets. In contrast, a corner stapling function or mode preferably inserts a single staple in one corner of a sheet set or stack at a 45 degree angle staple position relative to the sheet stack edges. It is further desirable to be able to perform both of these different stapling functions or modes with the same, single, but repositionable power-driven stapler, and desirably to be able to do so without a complex or costly mechanism for, repositioning that stapler unit, and without substantially interfering with normal sheet printing or feeding. (However, in certain situations additional staplers may be used for simultaneous edge stapling as in Xerox Corp. U.S. Pat. No. 4,516,714).

It will be appreciated that the systems and mechanisms disclosed in the embodiment herein are exemplary, and that others may be employed to achieve the disclosed function and result, utilizing the same basic concepts. The present system may be utilized with many different and known staplers. It does not require any particular type or mechanism of stapler per se, hence the stapler per se need not be described herein. Likewise, while the terms staplers and stitchers may vary in other usages, for distinguishing between precut or uncut (reel or spool fed) wire for the staple forming, for present purposes the term stapler may encompass both.

Various types of sheet staplers are known in the art, including those used for on-line or automatic stapling of sets of plural sheets being outputted by reproduction apparatus, such as printers or copiers, and/or their integral or associated finishers.

Staplers may have passive or active clinchers. Staplers with active clinchers are well-known and need not be described in detail herein. Some examples are disclosed in Xerox Corporation U.S. Pat. Nos. 4,358,040; 4,378,085; and 4,546,910.

A recent example of a leadscrew repositionable stack edge stapler, for stapling in plural selected positions along one side or edge of the set of sheets, is disclosed in Xerox Corp. U.S. Statutory Invention Registration (SIR) No. H1,842, published Mar. 7, 2000, entitled "Pass Through Repositionable Stapler-Compiler System with Clincher Alignment System," by Loren S. Tontarski. Also, U.S. Pat. No. 5,639,078 issued Jun. 17, 1997 to Barry P. Mandel, et al.

Various alternative mechanisms for moving a stapler along the stapling edge of a compiled stack, typically from the front to the back of the machine, or vice versa, i.e., perpendicular to the machine paper path, for selection of desired plural stapling positions, are shown in the cited and other patents, and thus also need not be described in detail herein. The following are further examples of staplers movable along one edge of the stack for variable edge stapling (a stapler which moves along one side of the stack of sheets to staple it in different positions): Xerox Corp. U.S. Pat. No. 4,516,714 issued May 14, 1985; Xerox Corp. U.S. Pat. No. 5,029,831; and a Xerox XDJ publication Vol. 4, No. 1., p. 59, of January/February 1979. Also, an Eastman Kodak U.S. Pat. No. 4,903,952.

The following additional patent publications are noted by way of some additional examples of staplers suitable for stapling together printed sheets (which may also include inserter or interposer sheets and/or covers) outputted by a printer or other reproduction apparatus, or components thereof. Examples of various such compiler/stapler finishing systems for copiers and printers include Xerox Corp. U.S. Pat. No. 5,029,831, issued Jul. 9, 1991 to Frederick A. Green; U.S. Pat. No. 5,289,251, issued Feb. 22, 1994 to Barry P. Mandel, et al; and U.S. Pat. No. 5,443,249 issued Aug. 22, 1995 to Charles D. Rizzolo, et al.

Of interest as to pivotally moving a stapler in and out of one side of the paper path for corner stapling (swing-in corner stapling of a sheet stack) is Xerox Corp. U.S. Pat. No. 4,313,670, issued Feb. 2, 1982 to John R. Caldwell, and U.S. Pat. No. 4,417,801, issued Nov. 29, 1983. However, that system only provides corner stapling, not any edge stapling.

A leadscrew rotary drive or other mechanism to automatically move a stapler linearly along a sheet stack edge for linear edge stapling in a finishing device has difficulty in also accomplishing the pivoting of that same stapler in and out of a 45 degree stapling position at the stack corner position, for stack corner stapling, when the operator or print job instructions change the print jobs between edge stapling to corner stapling. The disclosed embodiment provides a simple, reliable, and low cost system for providing stapler respositioning for corner stapling with the same linear drive used for stapler repositioning for edge stapling, not requiring a separate stapler pivoting drive or separate stapler.

A specific feature of the specific embodiment disclosed herein is to provide a dual mode stapling system, with a first stapling mode for plurally stapling a set of sheets parallel to one edge of the set of sheets, and a second stapling mode for corner stapling a set of sheets at an angle to the set of sheets, and a stapling mode transitioning system for transitioning said dual mode stapling system between said first and second stapling modes, said dual mode stapling system having a stapler mounted for linear movement relative to one edge of a set of sheets and a linear repositioning system for linearly repositioning said stapler to selected stapling positions along one edge of a set of sheets for said first operational mode, and wherein said stapler is selectively further movable by said linear repositioning system into a stapling mode transition area, and wherein said stapler is mounted for pivotal movement relative to said linear repositioning system, and wherein said stapling mode transitioning system automatically pivots said stapler into said second stapling mode for corner stapling a set of sheets at an angle to the set of sheets when said stapler is moved by said linear repositioning system into said stapling mode transition area.

Further specific features disclosed in the embodiment herein, individually or in combination, include those wherein said stapling mode transitioning system includes a camming member which engages and pivots said stapler when said stapler is moved by said linear repositioning system into said stapling mode transition area, and/or wherein said stapling mode transitioning system includes a fixed camming member which engages and pivots said stapler when said stapler is moved by said linear repositioning system into said stapling mode transition area, and a spring which reverse pivots said stapler when said stapler is not in said stapling mode transition area, and/or wherein said stapling mode transition area is adjacent to one end of said linear movement of said stapler by said stapler repositioning system, and/or wherein said linear repositioning system comprises a single stepper motor driven leadscrew for said linear movement of said stapler, and/or wherein said linear repositioning system is reversible, and wherein said stapling mode transitioning system includes a spring for automatically reverse pivoting said stapler when said linear repositioning system is reversed.

For automatic mode changes and/or automatic stapling position selections, the disclosed system may be operated and controlled in a known manner by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy."

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, the present invention will be better understood from this description of this specific embodiment, including the drawing figures (which are approximately to scale) wherein:

FIGS. 1 schematically shows in a top view one example of a dual mode repostionable stapling system, shown with its stapler in its linear movement stack edge stapling mode, in one of its sheet stack edge stapling positions, stapling a set of sheets which it has previously edge stapled in two other edge stapling positions;

Figure 2:
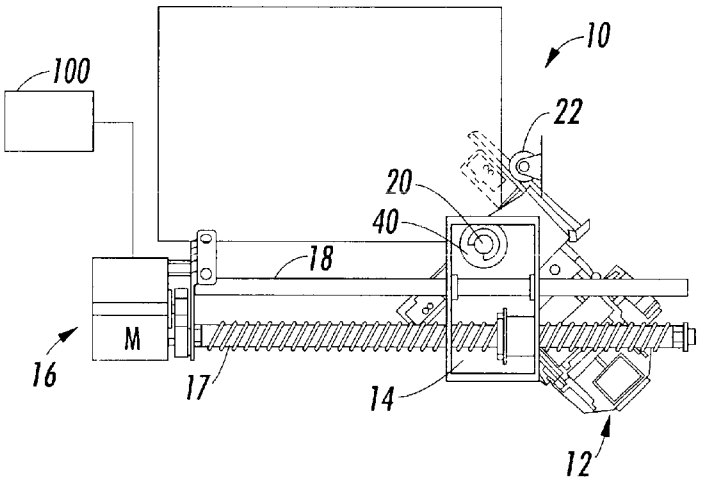
FIG. 2 is a similar schematic top view of the same exemplary dual mode repostionable stapling system, shown with the stapler pivoted into its corner stapling mode position for corner stapling a sheet stack.
Figure 1:
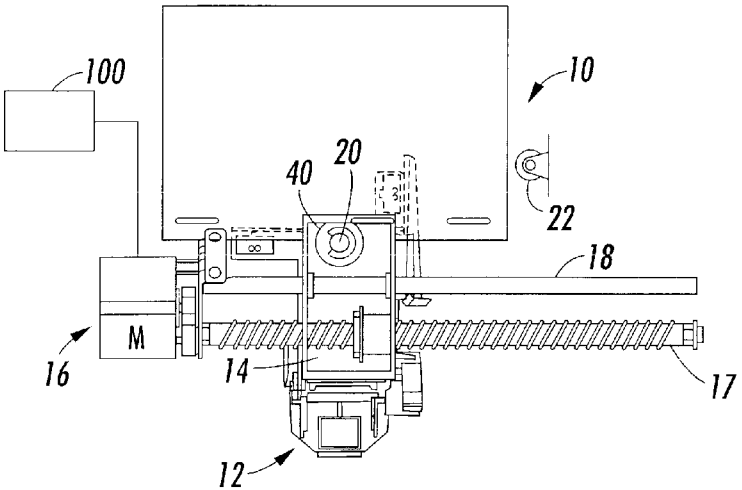
Figure 4:
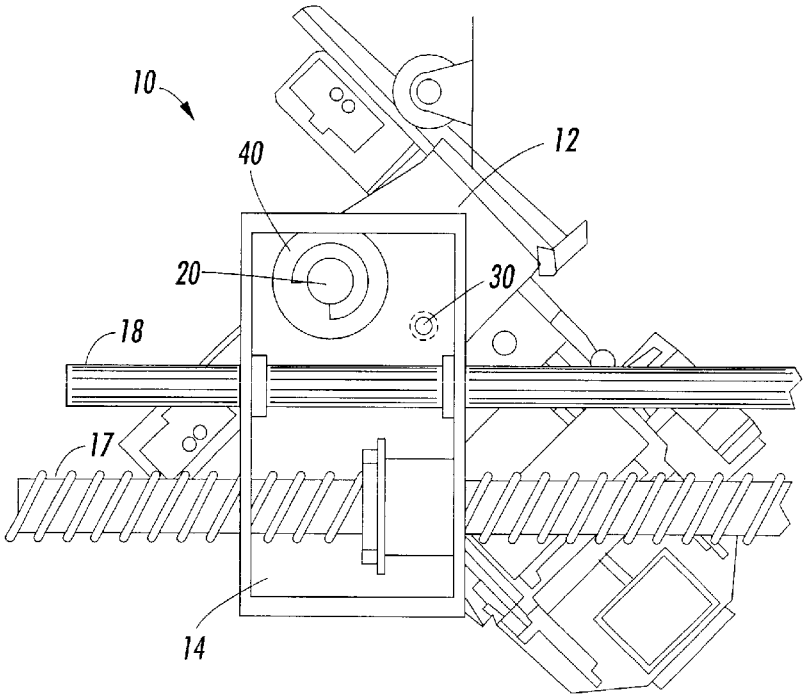
FIG. 4 is an enlarged view of the same stapler of FIG. 3, pivoted into its corner stapling position of FIG. 2.
Figure 3:
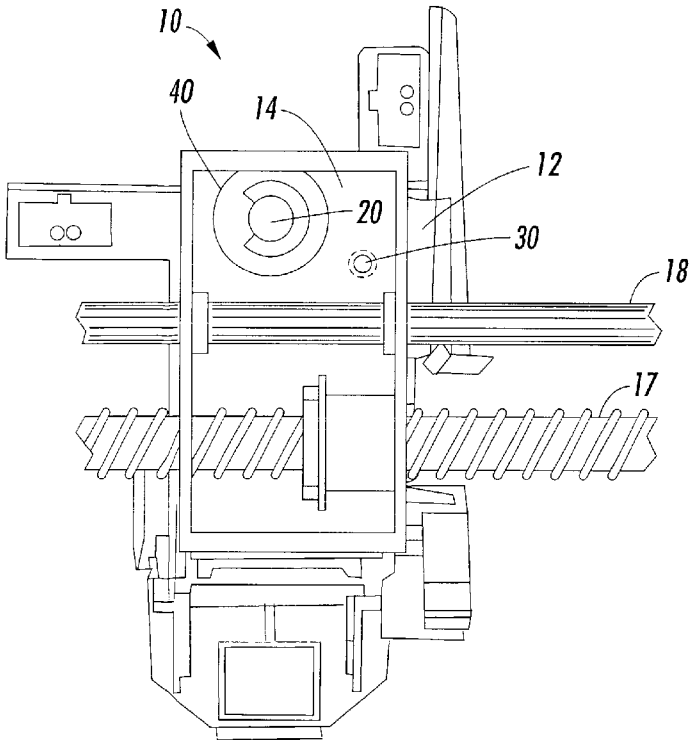
FIG. 3 is an enlarged view of the exemplary stapler and its mounting per se of the embodiment of FIGS. 1 and 2, in its edge stapling position of FIG. 1.

Describing now in further detail the exemplary embodiment with reference to the Figures, there is shown a dual mode sheet stapling system 10, with a single stapler 12, a slidable stapler mounting bracket system 14, and a repositioning system 16, by way of one example.

In this example the repositioning system 16 comprises an elongated leadscrew 17 for supporting and linearly driving the stapler mounting system 14, and its connected stapler 12, on controller 100 command signals, by a bidirectional stepper motor M rotating the leadscrew 17, to position the stapler 12 in desired stapling positions. A parallel slide rod 18 also conventionally supports the stapler mounting system 14, here a simple bracket. As the stepper motor M drives the plastic or metal leadscrew 17 (e.g., with 10 mm screw pitch), a mating threaded nut on the stapler mounting bracket 14 will index the stapler 12.

As will be further explained, this conventional leadscrew indexing system 16 of the system 10 provides an innovative way of moving the stapler 12 allowing for multiposition stack edge stapling as well as 45 degrees corner stapling with a linear movement of the stapler mounting system 14. That is, selectably moving the stapler head to allow either multiposition edge stapling or 45 degree stapling.

While it is known to guide the stapler head on slides or rails and have a stepper motor moving the stapler head, the difficult part for a dual mode stapling system is to somehow be able to reliably turn the stapler head into a 45 degree position relative to its multiposition edge stapling position without costly mechanisms and additional parts or drives.

In this dual mode stapling system 10 the stapler 12 is attached to the stapler mounting system 14 bracket through a single rotational pivot axis 20. As the leadscrew 17 drive indexing reaches the end of its path or stroke, moving the stapler mounting system 14 over to one side of the sheet path, it reaches a preset position in which a fixed extension roller bracket 22 or other member engages the stapler 12 at a position thereon spaced from the pivot axis 20, acting as a pivotal camming member. Thus, further driving of the leadscrew 17 drive in the same direction forces the stapler 12 to pivot about its pivot axis 20, and this is continued until the stapler 12 is pivoted into the desired 45 degree corner stapling angle position.

A conventional detent system 30 may be provided to insure the stapler is in that 45 degree position. When the leadscrew 17 advances the stapler 12 into the 45 degree position, a spring loaded hard metal ball may be thrust into a detaining groove, thus temporarily locking the stapler 12 to its mounting bracket 14 in the 45 degree position.

When the dual mode stapling system 10 is to return to an edge stapling mode from said corner stapling mode the leadscrew 17 is turned by the motor M in the reverse direction, and a spring 40 forces the stapler 12 to rotate back into a 90 degree stop-defined position, for parallel edge stapling, as soon as the pressure from the fixed extension roller bracket 22 is no longer overcoming that spring force.

While the embodiment disclosed herein is preferred, it will be appreciated from this teaching that various alternatives, modifications, variations or improvements therein may be made by those skilled in the art, which are intended to be encompassed by the following claims.

What is claimed is:

1. A dual mode stapling system, with a first stapling mode for plurally stapling a set of sheets parallel to one edge of the set of sheets, and a second stapling mode for corner stapling a set of sheets at an angle to the set of sheets, and a stapling mode transitioning system for transitioning said dual mode stapling system between said first and second stapling modes, said dual mode stapling system having a stapler mounted for linear movement relative to one edge of a set of sheets and a linear repositioning system for linearly repositioning said stapler to selected stapling positions along one edge of a set of sheets for said first operational mode, and wherein said stapler is selectively further movable by said linear repositioning system into a stapling mode transition area, and wherein said stapler is mounted for pivotal movement relative to said linear repositioning system, and wherein said stapling mode transitioning system automatically pivots said stapler into said second stapling mode for corner stapling a set of sheets at an angle to the set of sheets when said stapler is moved by said linear repositioning system into said stapling mode transition area.

2. The dual mode stapling system of claim 1, wherein said stapling mode transitioning system includes a camming member which engages and pivots said stapler when said stapler is moved by said linear repositioning system into said stapling mode transition area.

3. The dual mode stapling system of claim 1, wherein said stapling mode transitioning system includes a fixed camming member which engages and pivots said stapler when said stapler is moved by said linear repositioning system into said stapling mode transition area, and a spring which reverse pivots said stapler when said stapler is not in said stapling mode transition area.

4. The dual mode stapling system of claim 1, wherein said stapling mode transition area is adjacent to one end of said linear movement of said stapler by said stapler repositioning system.

5. The dual mode stapling system of claim 1, wherein said linear repositioning system comprises a single stepper motor driven leadscrew for said linear movement of said stapler.

6. The dual mode stapling system of claim 1, wherein said linear repositioning system is reversible, and wherein said stapling mode transitioning system includes a spring for automatically reverse pivoting said stapler when said linear repositioning system is reversed.

* * * * *